United States Patent [19]

Taylor

[11] 4,337,610

[45] Jul. 6, 1982

[54] ANIMAL CONTROL HALTER

[76] Inventor: Earl Taylor, 2244 Clinton La., Las Vegas, Nev. 89110

[21] Appl. No.: 231,762

[22] Filed: Feb. 5, 1981

[51] Int. Cl.[3] ..... B68B 1/02

[52] U.S. Cl. ..... 54/24; 54/15

[58] Field of Search ..... 54/6 R, 6 A, 15, 24, 54/71, 85

[56] References Cited

U.S. PATENT DOCUMENTS

| | | | |
|---|---|---|---|
| 1,278,021 | 9/1918 | Robinson | 54/24 |
| 3,306,005 | 2/1967 | Stafford | 54/24 X |
| 3,312,039 | 4/1967 | Reed | 54/24 |
| 3,458,971 | 8/1969 | Stern et al. | 54/15 X |

FOREIGN PATENT DOCUMENTS

| | | | |
|---|---|---|---|
| 34288 | 3/1925 | Denmark | 54/24 |

*Primary Examiner*—Gene Mancene
*Assistant Examiner*—Robert P. Swiatek
*Attorney, Agent, or Firm*—LaValle D. Ptak

[57] ABSTRACT

An animal control or training halter is of generally conventional construction with the exception that the nose piece is made of a rigid, curved metal bar covered with hard rubber. In addition to the conventional chin strap of the halter, an auxiliary control rope in the form of an endless loop is provided with a lead rope connecting ring attached to it and passes through a pair of auxiliary rings attached, respectively, to the connecting rings used on each side of the halter to interconnect the cheek straps, chin strap, and the rigid nose bar. When a lead rope is connected to the control rope, it causes, by virtue of its configuration, a clamping action to take place between the chin and nose of the animal applying pressure through the rigid nose piece to the animal's nose.

6 Claims, 4 Drawing Figures

FIG. 1
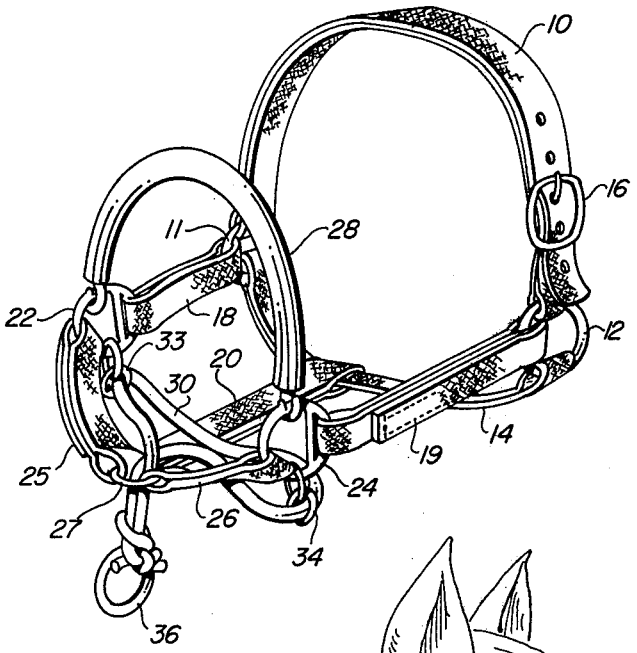
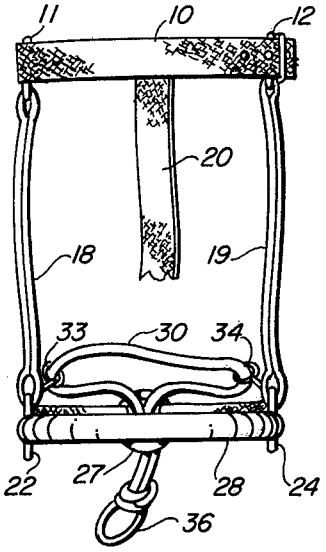
FIG. 4
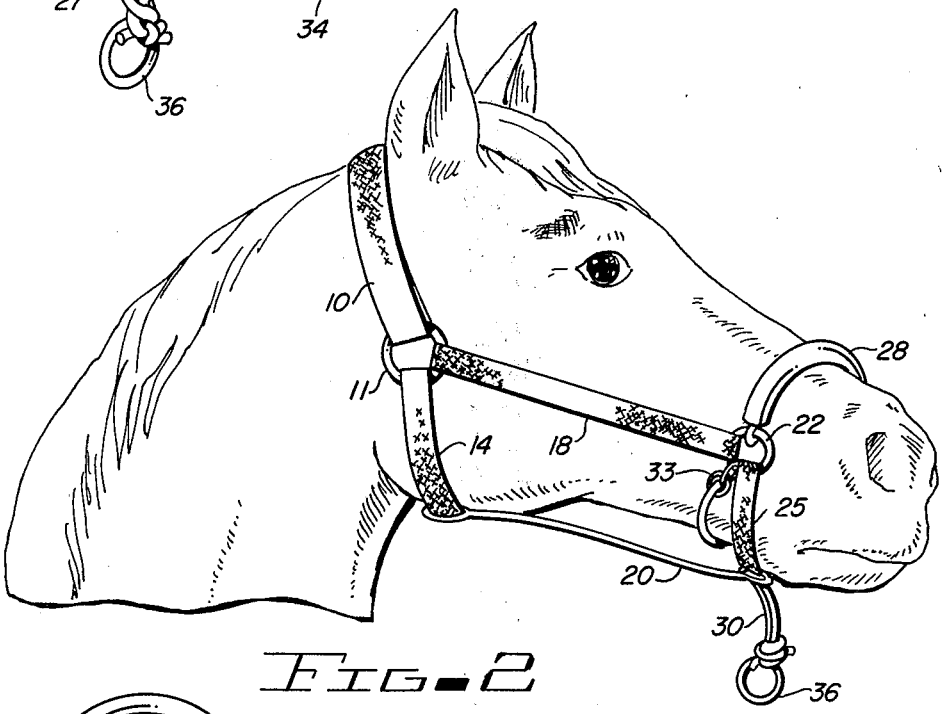
FIG. 2
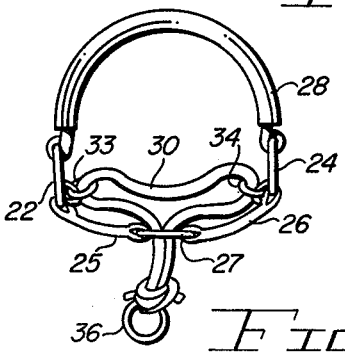
FIG. 3

ANIMAL CONTROL HALTER

BACKGROUND OF THE INVENTION

In the training and conditioning of animals, particularly horses, a variety of training or control halters, hackamores, bridles and the like, have been developed to assist a trainer in behavioral training of the horse. Most training halters and training hackamores operate on the principle of applying pressure to one or more pressure sensitive points on the horse's head whenever the horse undertakes an undesirable movement. The undesirable movements which a trainer wishes to eliminate from a horse's behavior include rearing or backing away from a halter or anchor when the horse is being tied, lead, loaded into a trailer, or the like.

A variety of specially designed training halters and training hackamores have been utilized in the past. A training halter which is typical of those available is disclosed in the patent to Woodruff, U.S. Pat. No. 3,949,538, issued Apr. 13, 1976. This patent discloses a halter constructed of first and second loops of rope which encircle the head and the nose, respectively, of the horse. One of the loops is arranged in a cross-over type of configuration to contract whenever the horse pulls back or rears its head against a force applied to a lead rope or anchor rope attached to this loop. Pressure knots or studs are located on the loops to apply pressure to nerve endings of the horse behind its ears and on each side of its head. The pressure which is applied under the contracting force of the loops causes a discomfort to the horse; so that it learns which movements cause discomfort and which ones do not. The Woodruff halter is only capable of use as a training halter and is not particularly practical for use as a conventional halter for a horse or other animal. In addition, because of the relative non-rigid construction of the material which is necessary for the functioning of the Woodruff halter, it acquires a shapeless form when it is not on the horse's head, therefore making it difficult to place on the head of the horse initially.

Various types of bitless hackamore bridles for training purposes also have been developed to apply a vice-like or squeezing pressure across the nose and chin of a horse for training purposes. Most training hackamores utilize a pivoting lever arrangement for attachment to the reins; so that when the reins are pulled back, a clamping effect occurs between the nose strap and chin strap of the hackamore. The pressure which results from this action is utilized by the trainer in behavioral training of the horse. Training hackamores of this general type are disclosed in the patents to Jones, U.S. Pat. No. 2,463,279, issued Mar. 1, 1949; Jones, U.S. Pat. No. 2,597,736, issued May 20, 1952, Mader, U.S. Pat. No. 4,132,054, issued Jan. 2, 1979, Newman, U.S. Pat. No. 2,804,740, issued Sept. 3, 1957, Thomas, U.S. Pat. No. 2,630,660, issued Mar. 10, 1953, and U.S. Pat. No. 3,998,033, issued Dec. 21, 1976. None of these patents are directed to training halters and all of them involve relatively complex and, accordingly, relatively expensive construction in the form of the various parts and levers which are necessary to effect their operation.

It is desirable, therefore, to provide a training halter having a construction which approximates that of a conventional halter and which is simple to construct and use.

SUMMARY OF THE INVENTION

It is an object of this invention to provide an improved animal control halter.

It is another object of this invention to provide an improved animal training halter.

It is an additional object of this invention to provide an improved control halter for training horses which operates to apply a clamping action to a portion of the horse's head in response to undesired movement.

It is a further object of this invention to provide a control halter for horses which has a rigid nose piece and which applies a clamping action between the chin and the nose piece in response to undesired movement of the horse.

It is yet another object of this invention to provide a control halter for training horses which includes an auxiliary chin strap and a rigid nose piece, wherein the chin strap operates to contract in response to movement of the horse away from a lead rope or anchor rope to thereby apply pressure through the rigid nose piece to the nose of the horse in response to undesired "pulling away" movements of the horse.

In accordance with a preferred embodiment of this invention, an animal control halter includes a crown piece which is connected to first and second cheek straps extending from the crown piece toward the front of the animal's nose. First and second connecting rings are connected to the respective forward ends of the first and second cheek straps. A curved, rigid nose bar, which is shaped to generally conform to the shape of the animal's nose, is connected at opposite ends to the first and second connecting rings. To effect the desired control function or training function of the halter, a control rope is coupled with the connecting rings in a manner to permit it to be connected to a lead or anchor rope. In response to tension on the lead or anchor rope, a constricting force is applied between the underside of the chin by the control rope and the rigid nose piece to squeeze this area of the animal's head. This action may be used for behavioral training of the animal.

BRIEF DESCRIPTION OF THE DRAWING

FIG. 1 is a perspective view of a preferred embodiment of a halter made in accordance with this invention in the configuration which the halter attains when it is mounted on an animal's head;

FIG. 2 is a side elevational view of the halter of Fmure 1 shown on a horse's head;

FIG. 3 is a front-end view of the halter of FIG. 1 showing details thereof; and FIG. 4 is a top view of a portion of the halter shown in FIG. 1 illustrating details thereof.

DETAILED DESCRIPTION

Reference now should be made to the drawing in which the same reference numbers are used throughout the several figures to designate the same components. FIG. 1 is a perspective view illustrating the shape attained by the animal control halter made in accordance with the preferred embodiment of the invention when it is placed on the head of an animal to be controlled, such as a horse. The other Figures illustrate different views of this same halter; and FIG. 2 shows it in position on a horse.

As is evident, particularly from FIG. 2, many components of the halter which is illustrated are those which are used in a conventional halter. Included in the halter is a crown piece 10 which goes over the head of the horse behind its ears, and this cooperates with a throat latch 14. The crown piece and throat latch are joined by a pair of rings 11 and 12, which also have a pair of cheek straps 18 and 19 attached to them. The straps 18 and 19 extend from the rings 11 and 12 toward the nose of the animal. A buckle 16 is provided on the side of the crown piece 10, which is made in two pieces; so that adjustment may be made for the heads of horses of different sizes. As is well known, the construction of the crown piece 10 in this manner also greatly facilitates the placement of the halter on the horse's head and its later removal from the horse when the halter no longer is needed.

A strap 20 also extends from the throat latch 14 toward the front portion of the halter where it is attached to what normally would be a lead rope attaching ring 27 for a conventional halter. The forward ends of the cheek straps 18 and 19 are attached to a pair of rings 22 and 24, respectively. These forward rings also are conventional and have a pair of flexible but relatively inextendable chin straps 25 and 26 attached to them and terminating in the lead rope attaching ring 27 to complete the underside of the halter.

The halter shown in the drawings differs from a standard halter in two very important aspects. First of all, the conventional nose strap has been replaced with a rigid nose strap 28. Typically, the nose strap 28 is made of a semi-circular metal bar or rod having a shape which generally conforms to the shape of the horse's nose. This bar is attached in a pivotal manner to the rings 22 and 24 by bending its ends over the rings, as shown most clearly in FIGS. 1 and 3. Since the hard surface of a metal bar made of brass or steel could be too severe in use of the halter, the bar typically is covered with a hard rubber cylinder or a plastic material such as neoprene and the like. The thickness of this covering material typically is on the order of one-eighth to one-quarter inches. The covering material is still substantially harder than a conventional halter nose strap, but reduces the severity of the hardness of the metal bar which it covers.

In the use of the halter as a training or control halter, it is desired to cause pressure to be applied by the rigid nose strap 28 to the bridge of the horse's nose to create a minor pain whenever the horse makes an undesired movement, typically by raising its head quickly or backing away from a rope anchor or a lead rope. It is desirable to release the pressure as soon as a desired behavior on the part of the horse takes place to remove the pain; so that the training conditioning is quickly learned by the horse. By utilizing this approach, the pressure pain which is created on the nose of the horse whenever it undertakes an improper or undesired movement is quickly associated by the horse with such movement, and training to eliminate undesired movements is greatly facilitated.

To effect the controlled application and release of pressure by means of the rigid nose band 28 to the nose of the animal, additional modifications have been made to the halter construction. These modifications consist of the addition of an endless loop control rope 30, which is shown in the drawings as passing through a pair of auxiliary guide rings 33 and 34, which in turn are attached to the rings 22 and 24 by means of a chain link. The ends of the control rope 30 are tied together and to a lead rope attaching ring 36 after they are passed through the ring 27 of the halter. This is shown most clearly in FIGS. 1 and 3. The portion of the control rope 30 which passes between the auxiliary rings 33 and 34 underlies the chin of the horse or other animal adjacent the chin straps 25 and 26, as shown in FIG. 2. When a lead rope is attached to the lead rope attaching ring 36, any substantial pulling pressure on the lead rope is transmitted immediately to the rope 30 to effect a clamping action between the rope 30 under the chin of the horse and the rigid nose strap 28. This tends to draw the rings 33 and 34 together as they swing inwardly to the position shown in FIG. 3 in response to such tension. As soon as the tension is relieved, the pressure on the rope 30 immediately is removed, which in turn, immediately removes the pressure applied by the rigid nose strap 28 on the nose of the animal.

By the selective application of pressure and its release, a trainer readily can cause the horse or other animal to identify its behavior with pain or the absence of pain. Because of the location of the control rope 30 and the manner in which it is connected with the other portions of the halter, the application and release of pressure is quickly and positively obtained. This is in contrast with the control halter shown in the Woodruff patent mentioned above, which, because of its interconnected and rather intricately arranged loops, is not capable of such nearly instantaneous and positive control from "pressure" to "no pressure" use.

If the training or pressure control function of the halter is not desired for any reason, a lead rope may be attached to the ring 27 in a conventional manner. Obviously, if there is a sudden and extreme rearing back of the horse or an intense pull on the ring 27, the bar 28 would cause discomfort in the manner described above. However, the clamping action between the chin of the horse and the bar 28 over its nose, which is effected by means of the control rope 30, would be absent if the halter were used in this manner.

The foregoing description of the preferred embodiment shown in the various Figures of the drawing is to be considered illustrative only of the invention and not as limiting. Various changes and modifications will occur to those skilled in the art without departing from the true scope of the invention.

I claim:

1. An animal control halter including in combination:

a crown piece connected to at least first and second cheek straps extending therefrom toward the front of the animal's nose;

first and second connecting rings connected, respectively, to the forward ends of said first and second cheek straps;

a chin strap connected between said first and second connecting rings for passing beneath the chin of the animal and having a guide ring therein at an intermediate point;

a curved, rigid nose bar, shaped to generally conform to the shape of the animal's nose, connected at opposite ends thereof to said first and second connecting rings; and control rope means having a portion thereof passing through the guide ring of said chin strap for connection to a lead rope, said control rope means connected through said first and second rings and having a chin portion for passing underneath the animal's head to apply a clamping action between said chin portion thereof and said nose bar.

2. The combination according to claim 1 wherein said nose bar comprises a bar made of rigid material encased in resilient material.

3. The combination according to claim 1 further including a throat strap and third and fourth connecting rings, wherein opposite ends of said throat strap, the other ends of said first and second cheek straps, and the ends of said crown piece are connected to said third and fourth rings.

4. The combination according to claim 1 wherein said control rope means includes first and second guide rings coupled respectively with said first and second connecting rings, and an endless loop control rope looped through said first and second guide rings under the chin of said animal and passing through said guide ring.

5. The combination according to claim 4 further including a lead rope attaching ring on said control rope.

6. The combination according to claim 4 wherein said nose bar comprises a bar made of rigid material encased in relatively resilient material.

* * * * *